United States Patent [19]

Takizawa et al.

[11] Patent Number: 4,970,800

[45] **Date of Patent: * Nov. 20, 1990**

[54] METHOD AND APPARATUS FOR GRADING AND MEASURING A SURFACE HAVING A CURVED PROFILE

[75] Inventors: Seiichiro Takizawa, Tokyo; Mitsuo Fukukawa, Saitama; Masayuki Yazawa, Chiba; Kazumitsu Asai; Yoshiharu Okamoto, both of Saitama; Tetsuo Tanaka, Tokyo, all of Japan

[73] Assignees: Kajima Road Company; Kajima Corporation, both of Tokyo, Japan

[ * ] Notice: The portion of the term of this patent subsequent to Aug. 8, 2006 has been disclaimed.

[21] Appl. No.: 312,040

[22] Filed: Feb. 17, 1989

Related U.S. Application Data

[62] Division of Ser. No. 65,528, Jun. 23, 1987, Pat. No. 4,852,278.

[30] Foreign Application Priority Data

Jun. 27, 1986 [JP] Japan ..... 61-149653
Jun. 27, 1986 [JP] Japan ..... 61-149654
Jul. 8, 1986 [JP] Japan ..... 61-158738

[51] Int. Cl.[5] ..... E02F 3/18

[52] U.S. Cl. ..... 33/561.3; 33/521; 37/108 A; 37/DIG. 1; 404/84; 364/424.07; 172/4.5

[58] Field of Search ..... 37/DIG. 1, 67, 108 A; 172/4, 4.5; 364/424.07; 33/177, 521, 523, 552; 404/72, 76, 84

[56] References Cited

U.S. PATENT DOCUMENTS 1,883,667 10/1932 Flynn ..... 37/108 A
3,334,560 8/1967 Long et al. ..... 172/4.5 X
4,031,963 6/1977 Poggemiller et al. ..... 172/4
4,133,033 2/1979 Noordermeer et al. ..... 364/424.07
4,332,517 6/1982 Igarashi et al. ..... 364/424.07
4,852,278 8/1989 Takizawa et al. ..... 37/197
4,854,769 8/1989 Fukukawa et al. ..... 404/84

FOREIGN PATENT DOCUMENTS 53-7736 3/1978 Japan .
172508 10/1983 Japan ..... 33/521
637969 12/1978 U.S.S.R. ..... 33/521

*Primary Examiner*—Randolph A. Reese
*Assistant Examiner*—Arlen L. Olsen
*Attorney, Agent, or Firm*—Beveridge, DeGrandi & Weilacher

[57] ABSTRACT

Apparatus is disclosed for grading and measuring surfaces such as roadbeds which have curved and inclined profiles which may have different shapes in successive transverse sections of the roadbed. A blade and screw cutter are supported by a frame which extends over the surface being worked, and these tools are movable along this frame. The tools are movable toward and away from the surface being shaped in response to a control means which has memorized the appropriate positions, or by reference to a deformable rule which may also be reshaped in response to computer-memorized data. According to a disclosed method, the rule is reshaped for different sections of the surface.

An apparatus for checking and measuring a surface which has a curved profile includes a plurality of piston-cylinder units which are mounted on a main frame. A flexible rule is connected by the piston cylinder units to the main frame, and controls are provided for setting the extended positions of the piston-cylinder units to control the shape of the flexible rule.

2 Claims, 11 Drawing Sheets

FIG. 6
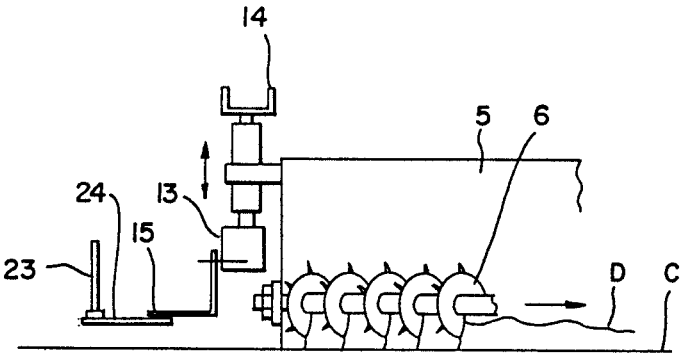
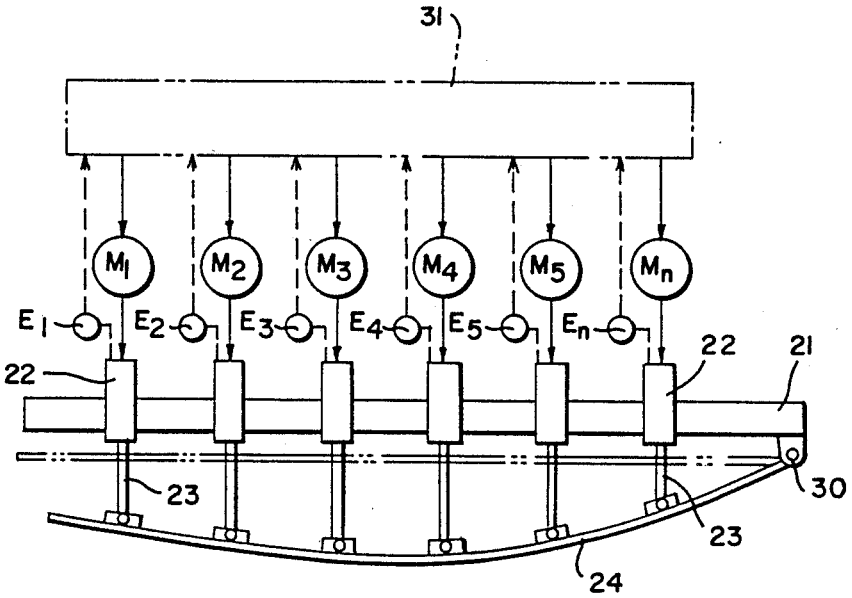
FIG. 7

FIG. 9
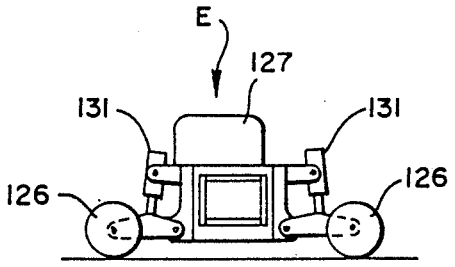
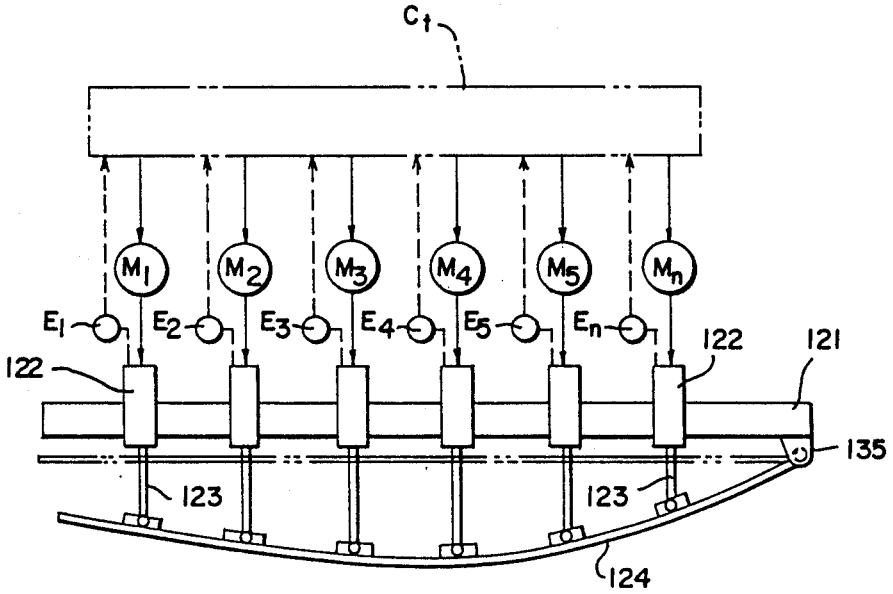
FIG. 10

METHOD AND APPARATUS FOR GRADING AND MEASURING A SURFACE HAVING A CURVED PROFILE

This application is a division of application Ser. No. 07/065,528, filed Jun. 23, 1987, now U.S. Pat. No. 4,852,278, issued Aug. 1, 1989.

BACKGROUND OF THE INVENTION

The present invention relates to a method and system for grading a curved inclined surface which may subsequently be paved. For example, the invention is useful in the construction of automotive test courses, cycling stadiums, levees, waterways and the like. The invention also relates to an apparatus for checking and measuring such a surface.

Heretofore, backhoes, bulldozers, and other earthworking machines have been used to grade inclined surfaces for automotive test courses, cycling stadiums, levees, waterways and other such locations. When using conventional techniques, the accuracy of the work and the time required to complete it are largely influenced by the skills of the machine operators. An automotive test course has a special three-dimensional curved surface, i.e. a surface of compound curvature, and this requires very careful work by experienced operators. This severely reduces the working efficiency, prolongs the time required for completion, and also increases the cost of construction.

Additionally, operators must check and measure whether a profiled surface has been correctly constructed to conform with the design perameters. In general, a three-dimensional curved surface of an automotive test course has profiles in transverse vertical planes which differ both within each profile and from one profile to the next along the length of the roadway. Therefore, accurate checking and measuring is extremely difficult.

In JP B No. 53-7736, there is a system wherein bent rails of constant length are coupled together by pins, and an hydraulic cylinder is provided for each rail. In such a system, it is difficult to grade a curved surface accurately to conform with design values, particularly when the surface is a special three-dimensional curved surface such as in an automotive test course.

It is an object of the invention to provide a method and system for efficiently and accurately grading a complicated inclined three-dimensional curved surface.

Also it is an object of the present invention to provide an apparatus for checking and measuring a curved surface which can easily determine whether or not every position therealong has been accurately constructed.

SUMMARY

One aspect of the invention pertains to an earthworking method for forming a surface which has sections which have different curved and inclined profiles. For a first section of the surface, a rule is formed into a first shape which corresponds to a first desired profile which is inclined and curved. A first section of the surface is shaped by using the rule in said first shape as a reference. The rule is then reshaped into a second shape which corresponds to a second desired profile which is inclined, curved, and different from the first shape. A second section of the slope is then shaped using the rule in said second shape as a reference.

In another respect, the invention pertains to a combination of a rule which provides a reference member, and an earthworking means which is moved in a path corresponding to the shape of the rule. The earthworking means has a main body frame which is elongated in the plane of the profile to be shaped, and a shaping means is mounted on a bracket which removes along the main body frame. The shaping means is also movable in a direction perpendicular to the main body frame, and means are provided for providing such movement. A rule setting apparatus has a main frame which is provided with a plurality of power cylinders and is elongated in the plane of the profile to be shaped. A flexible rule which is elongated in the plane of the profile has spaced apart points which are attached to the power cylinders. The earthworking means includes means for detecting the position of the rule, and a control unit for moving the shaping means in response to signals from the detecting means, thereby moving the shaping means in a path which corresponds to the shape of the rule.

According to another embodiment, the earthworking system has a shaping means which is supported on a bracket which is movably supported on a main body frame which extends generally in the direction of the plane of the profile to be shaped. Driving means are provided for moving the shaping means toward and away from the surface which is to be shaped. According to this aspect of the invention, the movement of the shaping means is controlled by a control means which includes (i) distance sensor means for measuring distances from a reference line to the shaping means and for providing output signals which are indicative of the measured distance, (ii) memory means for storing data indicative of desired positions of the shaping means relative to the reference line, and (iii) control means for sending signals to the driving means from the memory means to control the path of movement followed by the shaping means.

In another respect, the invention pertains to an apparatus for checking and measuring a surface. This apparatus includes an elongated main frame and an elongated flexible rule which are disposable across the surface, a plurality of piston-cylinder units which connect the main frame to the rule and are extensible toward the surface, and control means for setting the extended positions of the piston-cylinder units to control the shape of the flexible rule.

BRIEF DESCRIPTION OF THE DRAWINGS

FIG. 6 is a perspective view showing a screw cutter when ejecting scraped mud and sand.

FIG. 7 is an explanatory diagram of the rule shaping apparatus used in the embodiment of FIGS. 1-6.

FIGS. 8–10 illustrate one example of a checking and measuring apparatus which is constructed according to the invention. FIG. 8 is a side elevational view of this apparatus.

FIG. 9 is a front elevational view of a truck which is used in the apparatus of FIG. 8.

FIG. 10 is a diagram which shows the means for shaping the rule into a memorized recalled configuration.

FIG. 11 is a perspective view, partially in section, illustrating this embodiment.

FIG. 12 is a side elevational view showing the apparatus of FIG. 11.

FIG. 13 is a front view of a suitable earthworking means for shaping the surface in the FIG. 11 embodiment.

FIG. 14 is a block diagram showing a suitable control apparatus for the embodiment shown in FIG. 11–13.

FIG. 15 is a flowchart showing the operation of the embodiment of FIGS. 11–13.

DETAILED DESCRIPTION

According to the present invention, the means for shaping the roadbed is controlled by a computer. The principle will be explained with reference to FIG. 11. For example, the slope face C of an automotive test course has three dimensional or compound curves. The cross sections Al to An differ depending on the positions thereof. The shape of any cross section can be obtained by giving the design task to a calculating equation. For example, the heights y1, y2, . . . yn to the horizontal distances x1, x2, . . . xn from a reference point b can be obtained by calculations. These values can be expressed as shown, for example, in the following table:

| | x1 | x2 | xn-1 | xn |
|---|---|---|---|---|
| A | 3 | 5 | 14 | 15 |
| A2 | 8 | 15 | 45 | 50 |
| An | yl | y2 | yn-1 | yn |

Figure 1:
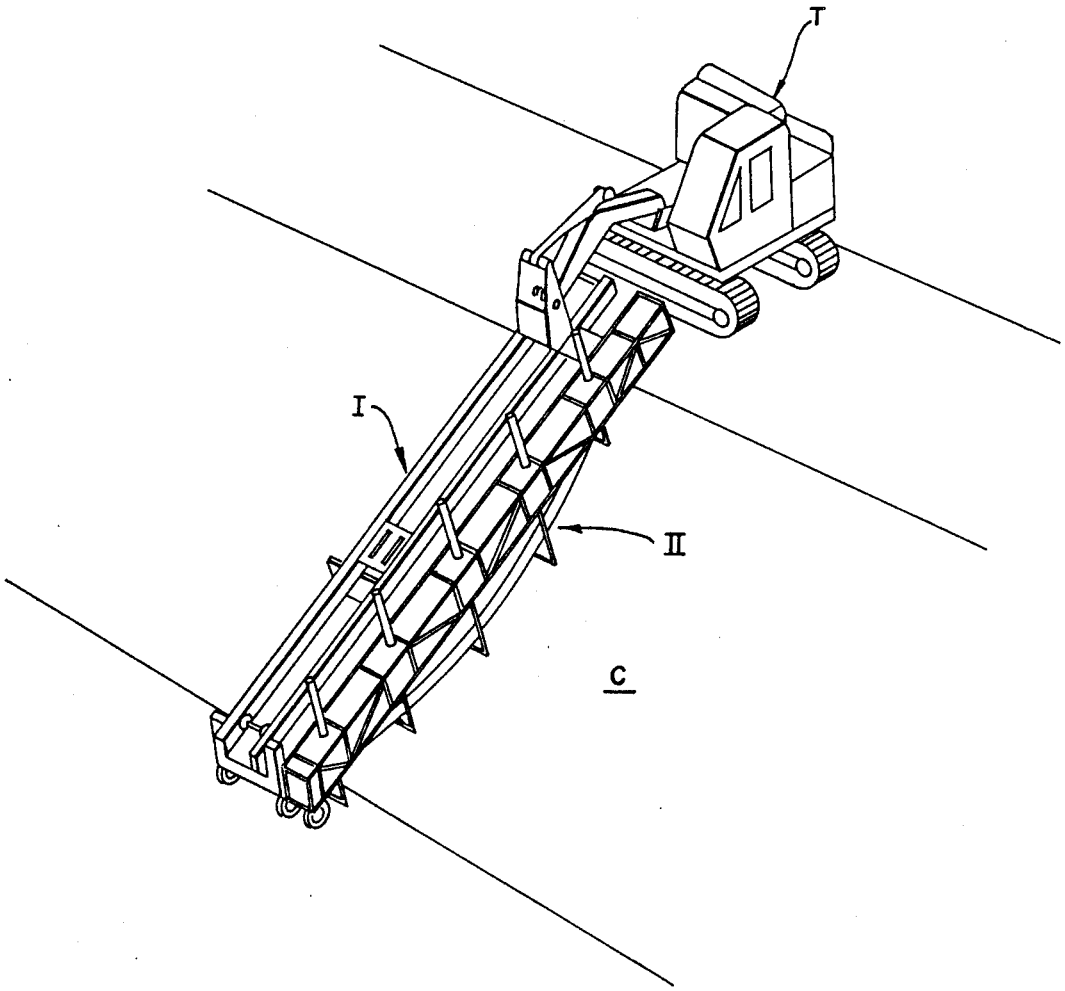
FIG. 1 is a perspective view showing an example of a system to which the present invention is applied.

A first embodiment of the invention is disclosed in FIGS. 1–7. FIG. 1 shows a sloped face C which is shaped by earthworking machinery to form a roadbed. A tool-moving apparatus I and a rule setting apparatus II are adjacently supported by a tractor T which is movable in a direction which lies lengthwise of the slope face C. The apparatuses I and II may be carried and moved by different tractors if desired.

Figure 2:
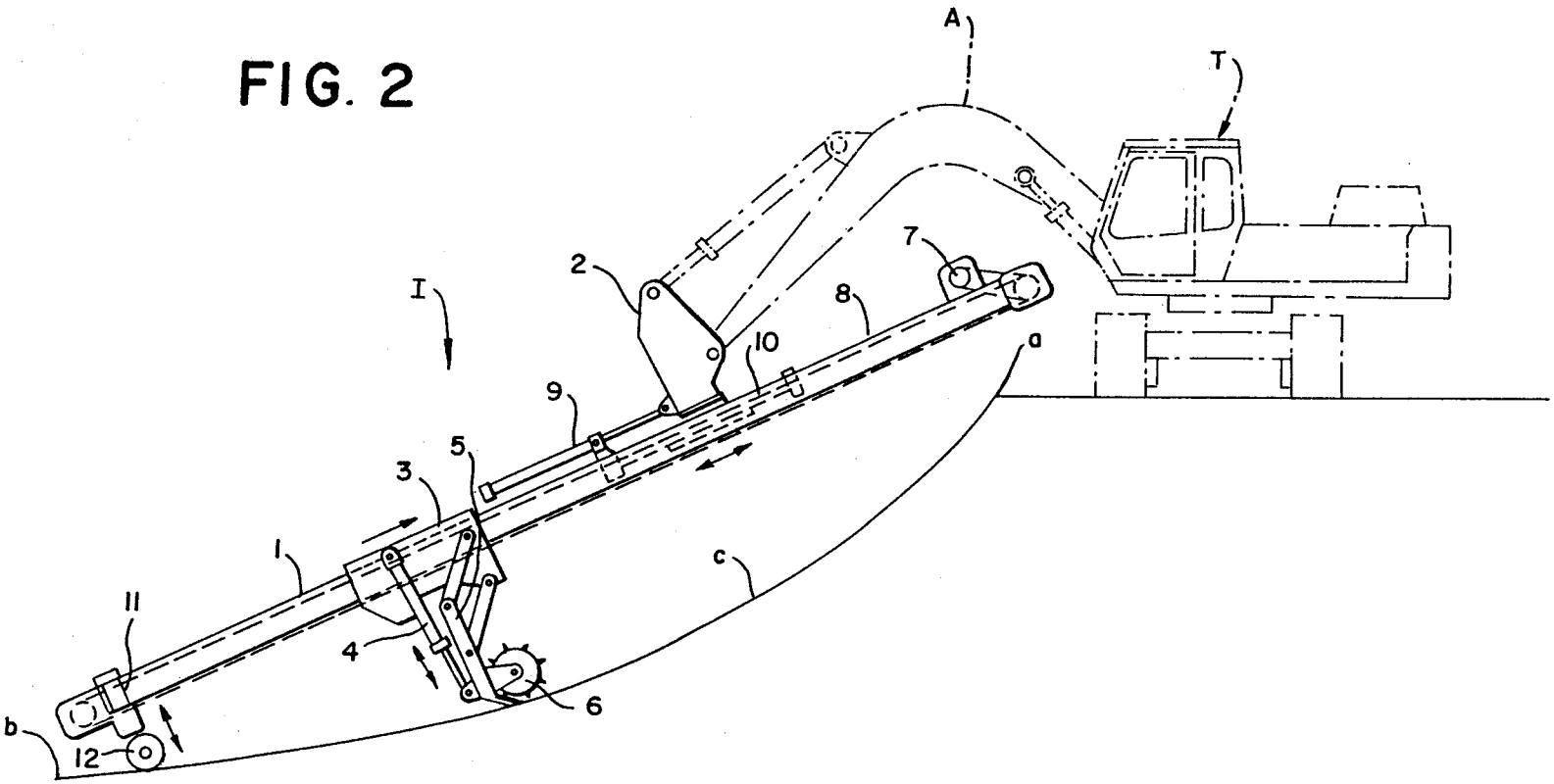
FIG. 2 is a side elevational view showing the apparatus for moving a shaping means according to the invention.

FIG. 2 is a side elevational view of the tool moving apparatus I. It has a bracket 2 which is slidably mounted on an elongated main frame 1. The main frame 1 is coupled by a bracket 2 to a backhoe T or any other suitable supporting tractor. Another bracket 3 is attached to and slidable along the main frame 1. This bracket 3 carries a blade 5 and a screw cutter 6 which are the earthworking tools which grade and shape the inclined surface. These tools are vertically adjustable by means of an hydraulic cylinder 4, and they are movable along the frame 1 by a chain 8 which is driven by a motor 7.

The main body frame 1 is attached to the bracket 2 by a slide shaft 10 which enables the position of the frame 1 to be changed with respect to the bracket 2 by a hydraulic cylinder 9. Further, wheels 12 are attached to the lower end of the main body frame 1, and height adjustments of these wheels may be made by an hydraulic cylinder 11.

Figure 3:
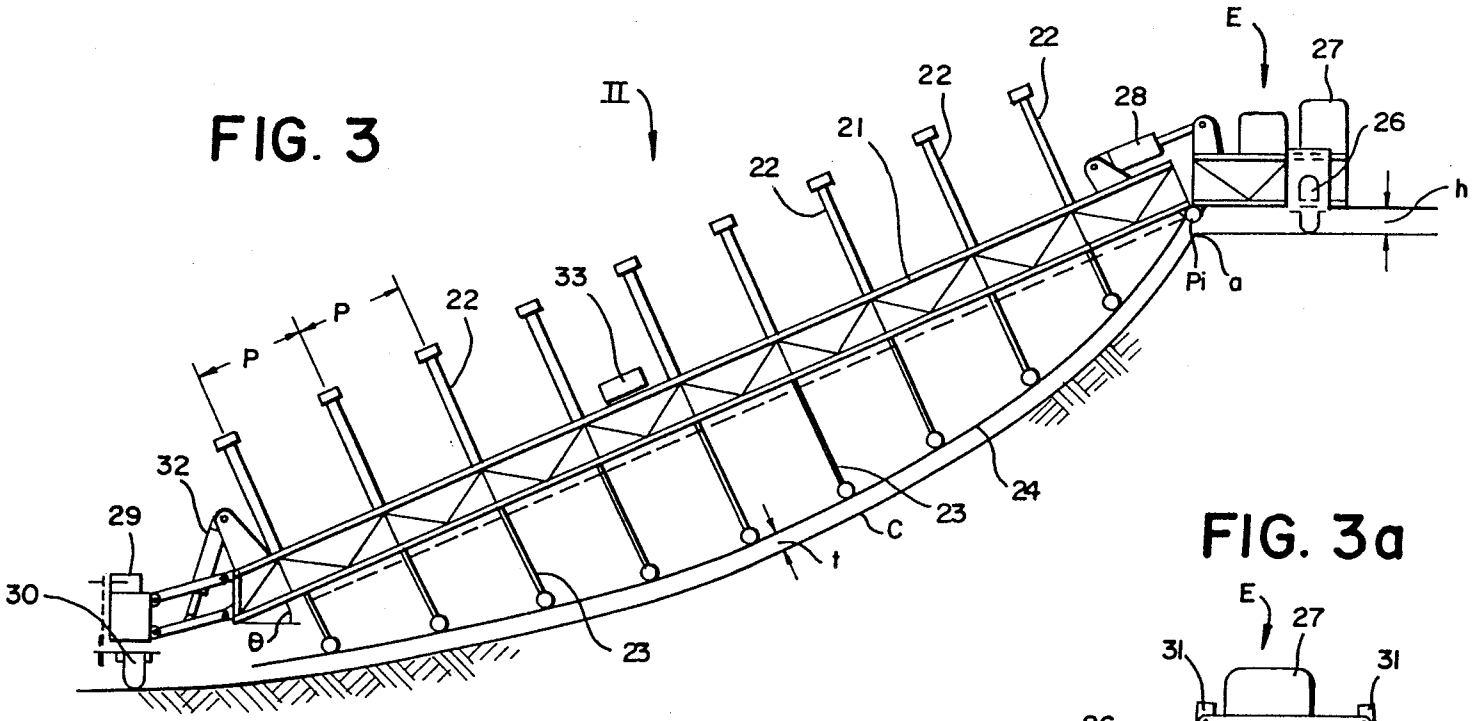
FIG. 3 is a side elevational view of a rule setting apparatus according to the invention.
Figure 3A:
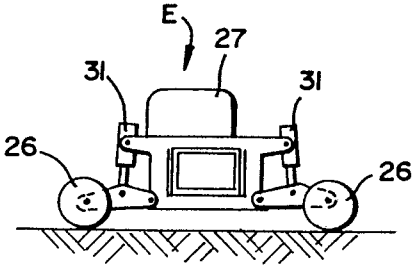
FIG. 3*a* is a front view of a truck used in the apparatus of FIG. 3.

FIG. 3 shows a side elevational view of an embodiment of the rule setting apparatus II. In this example, the rule setting apparatus II is mounted on a truck E rather than the tractor T. A plurality of power cylinders 22 are attached to a main frame 21 at fixed distances P from each other. A flexible rule, guide rail 24, is attached to the piston rods 23 of the cylinders 22. As shown in FIG. 3*a*, the truck E has wheels 26 which are driven by a motor. A prime mover 27 is attached to the upper end of the main frame 21. The truck E is coupled by a pin Pl so that the inclination angle $\theta$ of the main frame 21 can be freely changed by operation of a cylinder 28. Wheels 30 which are driven by a motor 29 are attached to the lower end of the main frame 21. The heights of wheel 26 and 30 can be adjusted by cylinderds 31 and 32, respectively. Angle sensors 33 are attached to proper positions of the main frame 21 in order to detect the inclination angle $\theta$ of the frame 21. By controlling the cylinder 31, the height h of the truck E can be adjusted. On the other hand, the respective cylinders 22 are controlled in such a manner that the rule or guide rail 24 has a shape corresponding to the design profile of slope face C with an interval or constant spacing t away from the slope face.

According to the invention, the shaping operations are performed by moving the shaping means, blade 5 and screw cutter 6, along a path which conforms to the rule or guide rail 24. The components which provide this cooperation are shown in FIGS. 4–6.

Figure 4:
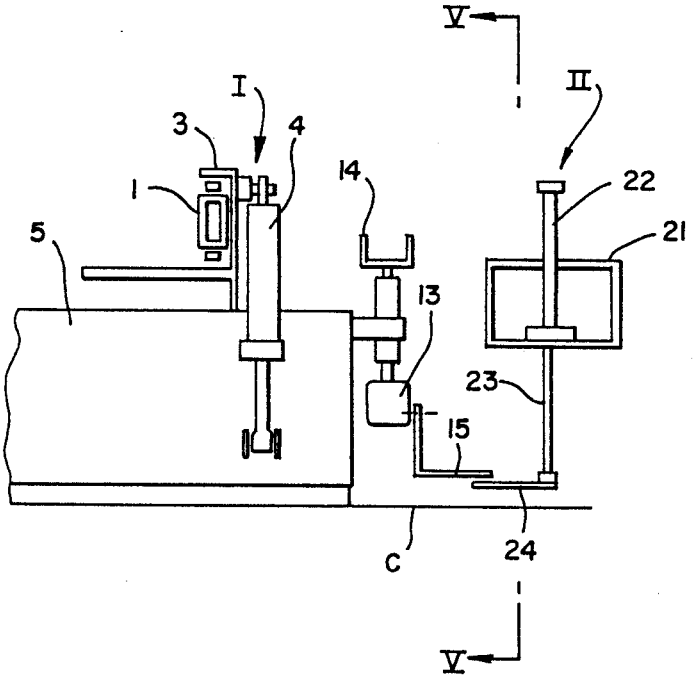
FIG. 4 is a front view showing an earthworking site in which the shaping means is operated by using a curved rule as a reference.
Figure 5:
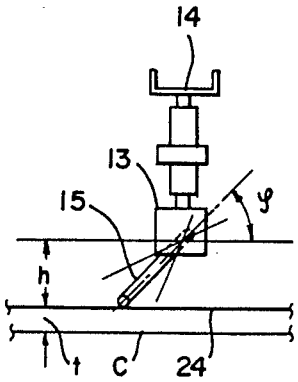
FIG. 5 is a side elevational view along the line V—V in FIG. 4.

In FIGS. 4 and 5, a detecting apparatus 13 is attached to one side of the blade 5 so that its height relative to the blade can be adjusted by a handle 14. The detecting apparatus 13 is of a type previously used in asphalt finishers. It sends a signal to a control means which controls the cylinder 4 to adjust the height of the blade 5 relative to the frame 1 and bracket 3. As shown in FIG. 5, the detecting apparatus 13 senses the angle $\psi$ of an arm 15. The arm 15 is pivotally attached to the detecting apparatus 13 and is arranged to engage the rule or guide rail 24. The apparatus is set so that the height h is set to be constant, thus the blade 5 can be accurately positioned to correspond to the position of the desired profile of the slope. It will be understood that the curved surface corresponding the guide rail 24 is the curved surface which is located a constant distance t below the guide rail 24.

In operation, the tractor T is first disposed at a predetermined position as shown in FIG. 2. An arm A of the tractor T is lowered to set the main body frame at a starting position. The wheels 12 rest on the ground and the hydraulic cylinder 11 is set at a fixed height. The bracket 3 which carries the blade 5 is moved along the frame 1 to the lower edge b of the slope face, and the hydraulic cylinder 4 is operated to locate the lower edge of the blade 5 at a predetermined height for shaping.

Next, the rule or guide rail 24 of the rule setting apparatus II is adjusted and shaped so as to have a predetermined desired curved surface which is parallel with the desired profile or shaping line C. In this state, as shown in FIGS. 4–6, the sensor arm 15 of the detecting apparatus 13 engages the rule 24. Then, the height of the sensor 13 is adjusted by the handle 14 so that the angle of the arm 15 is at a neutral angle. The screw cutter 16 is then rotated by a hydraulic motor, and the blade-carrying bracket 3 is moved along the frame 1 to the upper side a of the slope face. This movement is produced by the motor 7 and chain 8, and it scrapes the slope face C to a desired height. As shown in FIG. 6, mud and sands D are ejected out to one side of the blade. In this manner, the roadbed is automatically profiled to conform with the shape of the preset rule 24.

The rule 24 may be made of any material such as wood, iron, pipe or the like. If the desired profile of the roadbed is linear, a piano wire may be used.

After a first portion of the roadbed has been shaped as described above, the boom of the tractor T is raised to elevate the shaping apparatus from the ground surface. The shaping apparatus is then moved a short distance along the length of the roadbed to the next adjacent working position. The foregoing operations are repeated at this working station, but it is necessary to reshape the rule or guide rail 24 if the desired profile at this successive working station is different from the profile at the first working station.

If a roadbed has a special curved profile which changes from one working position to another, it is troublesome to reshape the rule 24. Therefore, means are provided for easily and promptly reshaping the rule. In FIG. 7, it will be seen that a plurality of power cylinders 22 are mounted on the main frame 21, and the ends of piston rods 23 are attached to the guide rail 24. One end of the guide rail 24 is attached to the main frame 21 by a pin 30. A control unit 31 includes a memory device and a control apparatus.

$M_1$–$M_n$ denote electric motors, and $E_1$ to $E_n$ indicate rotary encoders which detect the extension lengths of the piston rods 23.

The desired profile of the slope face C at each position along the roadway has previously been calculated, and these profiles are stored in the control unit 31. When the working position is input to the control unit 31, the extension lengths of the power cylinders 22 are recalled and the electric motors $M_1$ to $M_n$ are driven to extend or retract the power cylinders 22 to the memorized distances. The extension lengths of the power cylinders are detected by the rotary encoders $E_1$ to $E_n$, returned to the control unit 31, and automatically set into the instruction values which have been preliminarily stored. In this manner, the guide rail 24 is automatically adjusted into a predetermined shape. Therefore, the roadbed which has a slope face with a special complicated curved surface can be very easily and accurately formed by use of the guide rail 24.

The rule setting apparatus II can also effectively be used to measure a test course during construction and to inspect the test course after construction.

After completion of the shaping operation in the first transverse section of the roadway, the shaping system is moved to the next adjacent transverse section where the rule is reshaped to correspond to the calculated and memorized data pertaining to the desired profile of the new section of the roadbed. The shaping operation of the screw cutter 6 and blade are repeated and are again guided by the rule 24. These operations are sequentially repeated until the entire length of the slope face is shaped.

Figure 8:
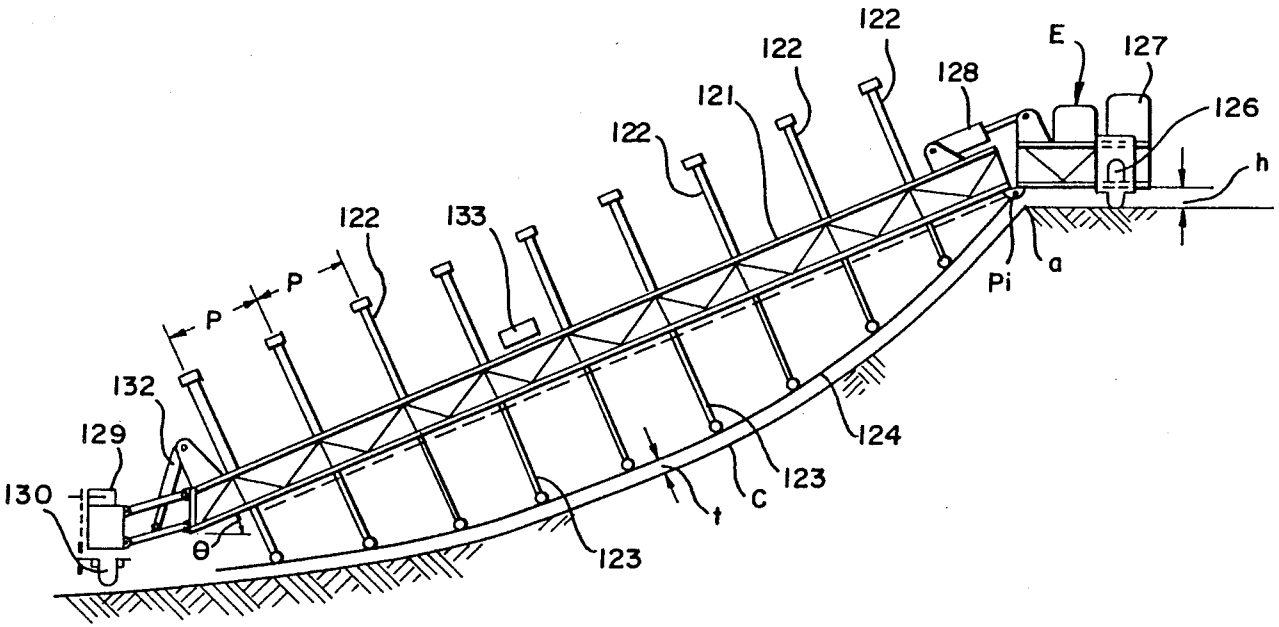

The second embodiment of the invention is shown in FIGS. 8–10, where FIG. 8 illustrates an overall checking and measuring apparatus. A plurality of power cylinders 122 which serve as extensible actuators are attached to a main frame 121 at a proper pitch P. A flexible rule 124 is attached, at spaced points, to the ends of the piston rods 123 of cylinders 122. A running truck E with wheels 126 driven by a motor and a prime mover 127 is disposed on the upper end of the main frame 121. The truck E is coupled to the frame 121 by a pin Pi so that the inclination angle $\theta$ of the frame 121 can be freely changed by a cylinder 128. The lower end of the main frame 121 is supported by wheels 130 which are driven by a motor 129. The heights of the wheels 126 relative to the frame can be adjusted by cylinder 132. The height h of the truck E can be adjusted by controlling the cylinder 131 shown in FIG. 9. As shown in FIG. 8, angle sensors 133 are attached to proper positions of the main frame 121 in order to detect the angle 0 of inclination of the main frame 121. Each cylinder 122 is controlled so that the rule 124 has a shape corresponding to the profile of the designed and desired curved surface C at a constant distance t therefrom.

When the surface C is linear or is uniform from one position to another along the length of the roadbed, the task of shaping the rule 24 is not difficult. However, when the surface C has special curvatures as in an automotive test course, it is troublesome to reshape the rule 124 repeatedly. FIG. 10 illustrates a suitable means for simplifying the rule-reshaping operations.

The ends of the piston rods 123 are attached so as to be slidable along the guide rail 124. One end of the guide rail 124 is attached to the main frame 121 by a pin 135. A control unit Ct has a memory device and a control apparatus. In the diagram, Ml to Mn denote electric motors and El to En indicate rotary encoders which detect the projection distances of the piston rods 123.

The desired profile of the curved surface C at each measuring point has previously been calculated and is stored in the control unit Ct. When the position of the measuring point is entered into the control unit, a signal corresponding to the memorized displacement of the guide rail 124 at the position of each power cylinder 122 is sent from the control unit Ct to drive the electric motors Ml to Mn, thereby extending or retracting the power cylinders 122. The extensions of the power cylinders are detected by the rotary encoders El to En, fed back to the control unit Ct and automatically set to instruction values which have previously been stored. In this manner, automatic controls set the rule 124 into a predetermined shape. Therefore, a complicated special curved surface can be easily and accurately checked and measured by the rule 124.

In operating the apparatus shown in FIG. 8, the apparatus is disposed over the curved surface C and the extension position of each piston rod 123 is determined by the control unit Ct as mentioned above. The rule 124 is located over the surface at only a distance t away from the surface C. The curved surface C can then be checked by measuring the distance t. Next, the wheels 126 and 130 are driven and the truck E is moved to the next transversely extending section which can be checked and measured as described above. In this manner, the checking and measuring operations are repeated to check and measure the profiles of the subsequent sections along the roadway.

Figure 11:
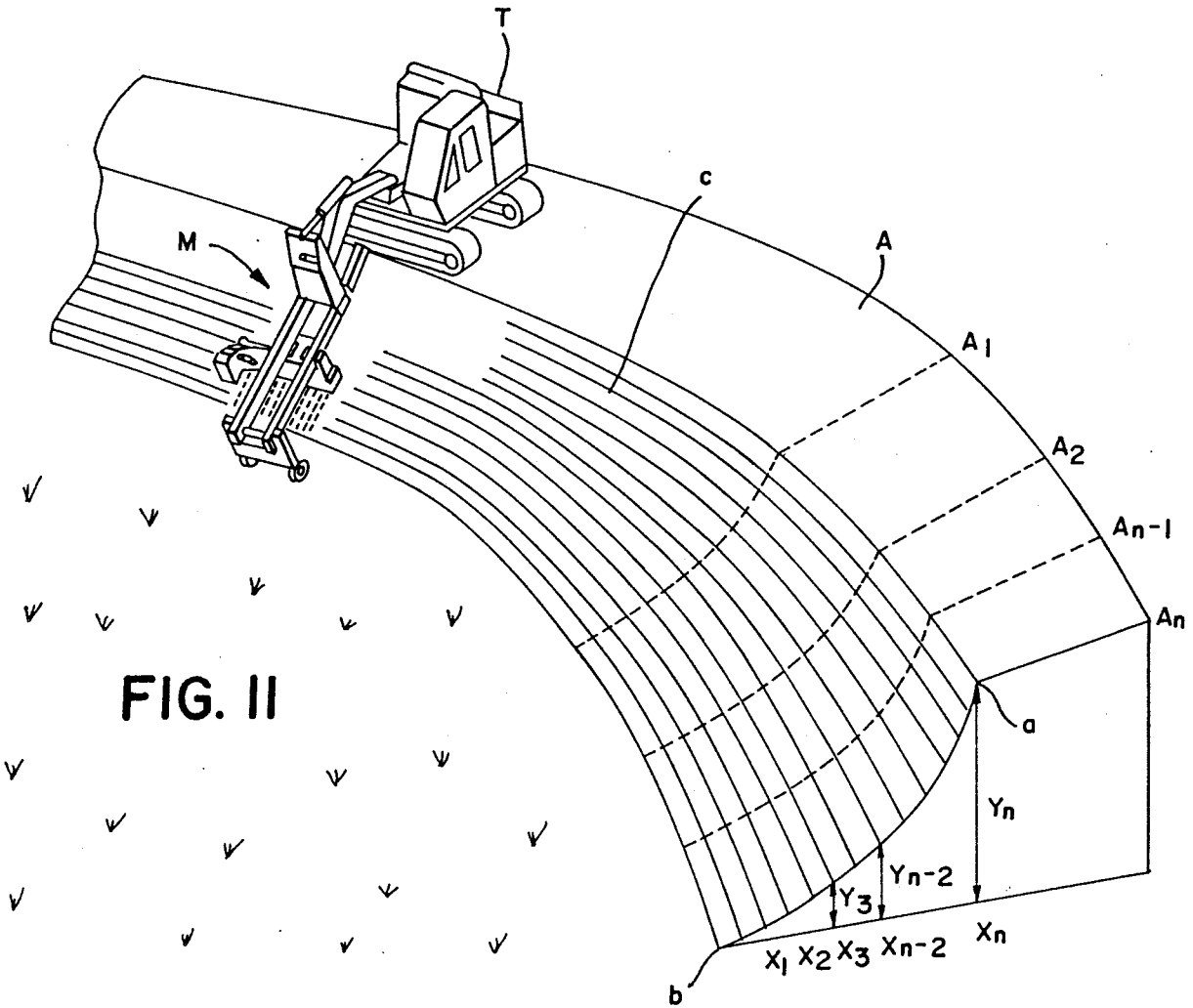
FIGS. 11–15 show another embodiment of a surface shaping apparatus according to the invention.
Figure 12:
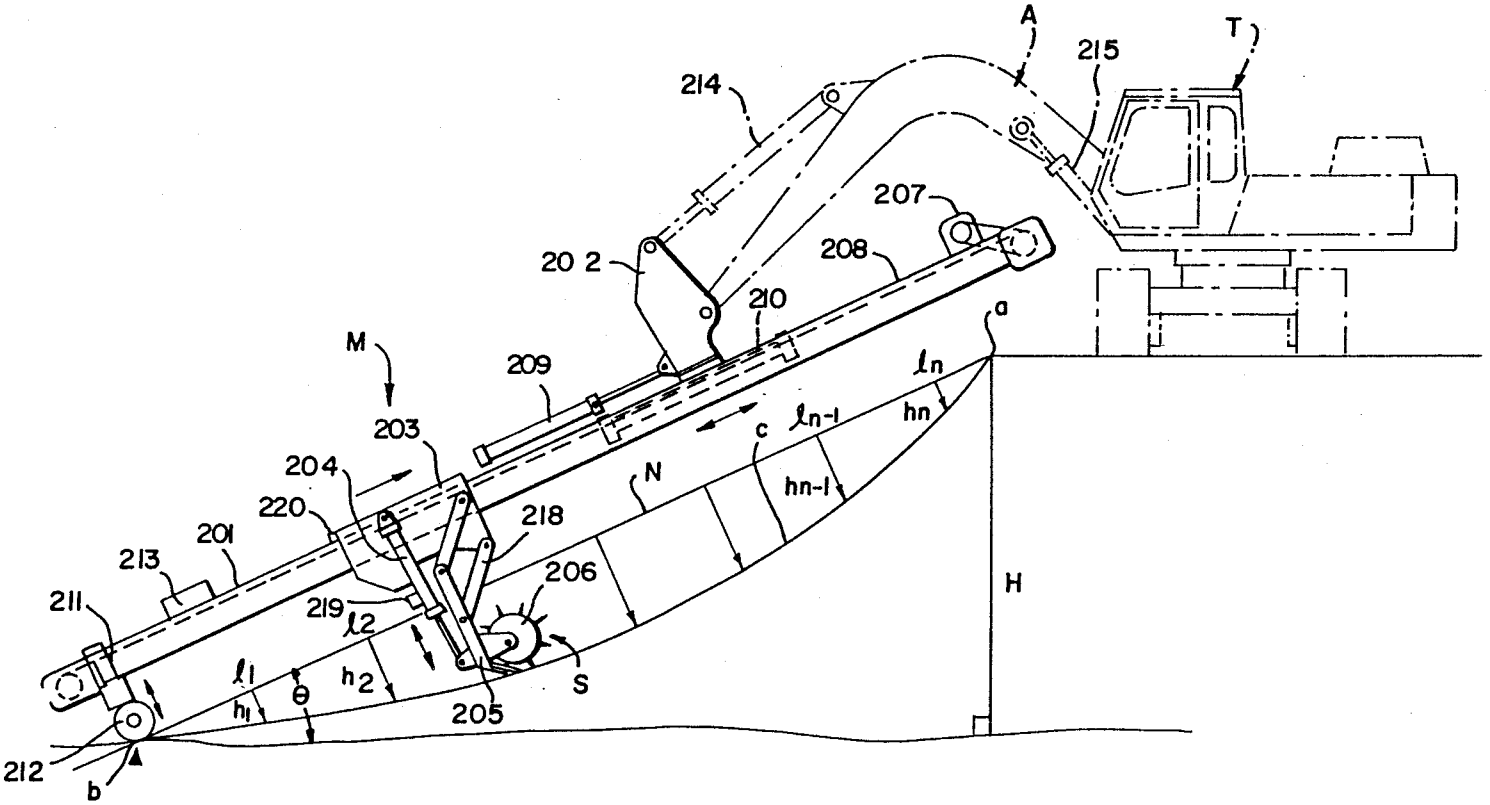

A third embodiment of the invention is shown in FIGS. 11 to 15. FIG. 12 shows the system supported on an arm A of a tractor T, and the tractor is disposed so as to run in a longitudinal direction adjacent to the upper edge of the roadbed.

The apparatus M in FIG. 12 includes a main body frame 201, a bracket 203 which is movable along the frame 201, and shaping means S attached to the bracket 203 so as to be movable in a direction perpendicular to the frame 201.

The main frame 201 is connected to the tractor T by an arm A and a bracket 202. A slide shaft 210 is able to slide the frame 201 relative to the bracket so that the position of bracket 202 can be changed by a hydraulic cylinder 209.

A driving motor 207 on one end of the frame 201 moves a chain 208 which is affixed to the bracket 203. The bracket 203 is thus moved along the frame 201 by the motor 207 and chain 208. A pair of wheels 212 are attached at the lower end of the main frame 201, and the heights of these wheels can be adjusted by a hydraulic cylinder 211. An inclination angle sensor 213 is also attached to the frame 201.

Figure 13:
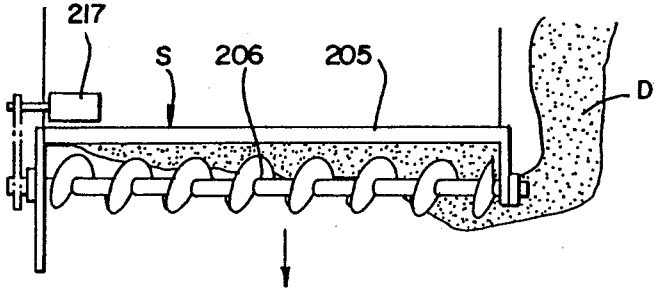
Figure 14:
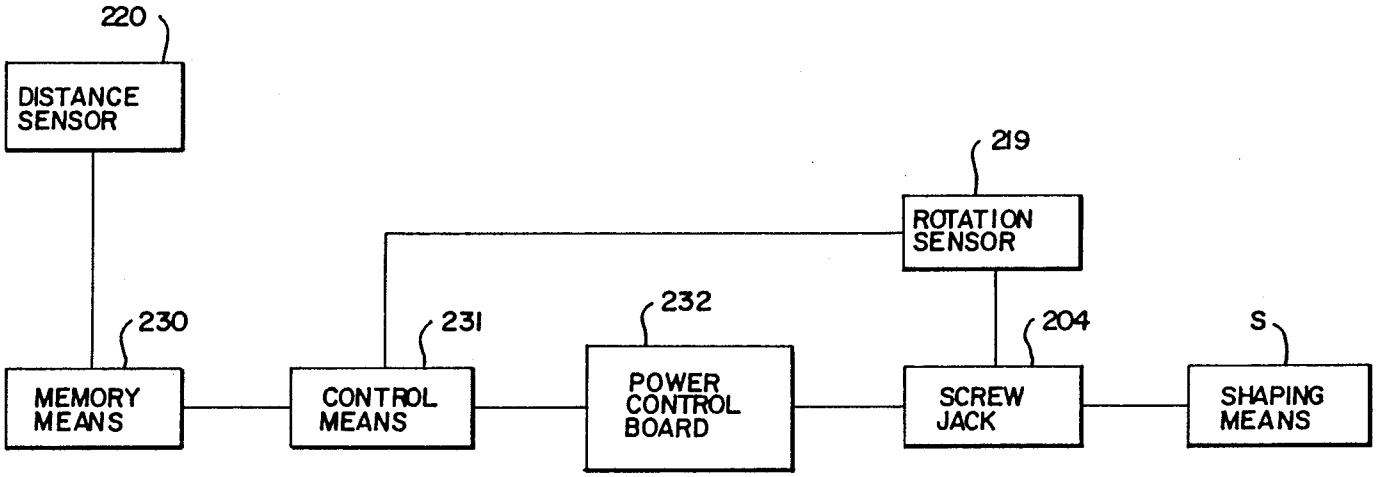

As also shown in FIG. 13, the shaping means S consists of a blade 205 and a screw cutter 206. These components are attached to the bracket 203 by a parallel link mechanism 218 which is driven by a vertical screw jack 204 in order to move the blade 205 and screw 206 in a direction perpendicular to the frame 201. The rotating amount of the screw jack 204 is measured by a rotation sensor 219, and the displacement of the bracket 203 from a reference point is measured by a sensor 220. The screw cutter 206 is driven by a motor 217 as shown in FIG. 13.

Referring to FIG. 12, the data of the distances h1, h2 . . . hn to the slope face C at the positions l1, l2, . . . ln along the reference line N are previously calculated and stored. This data is input to control means 231 in FIG. 14, and the screw jack 204 is driven to move the shaping means S vertically. The distance of this vertical movement is measured by the rotation sensor 219 and fed back to the control means 231 so that the screw jack 204 operates in accordance with the memorized data.

For purposes of describing the operation of the embodiment of FIGS. 11–15, it is assumed that the transverse section A2 shown in FIG. 11 has already been shaped and the tractor T and the shaping apparatus M have been moved to the next adjacent transverse section A2 of the roadbed. When the angle sensor is set to a predetermined angle $\theta$, the hydraulic cylinder 214 operates automatically to set the main body frame 201 at an angle equal to the angle $\theta$ between the horizontal plane and the reference line N connecting the reference points a and b. The angle $\theta$ is automatically controlled as to be constant, even when the arm A is vertically moved by a cylinder 215.

Next, the cylinder 209 is driven to slide the frame 201 until the wheels 212 come to the reference position b. The wheels are then fixed to complete the placement of the apparatus M.

Figure 15:
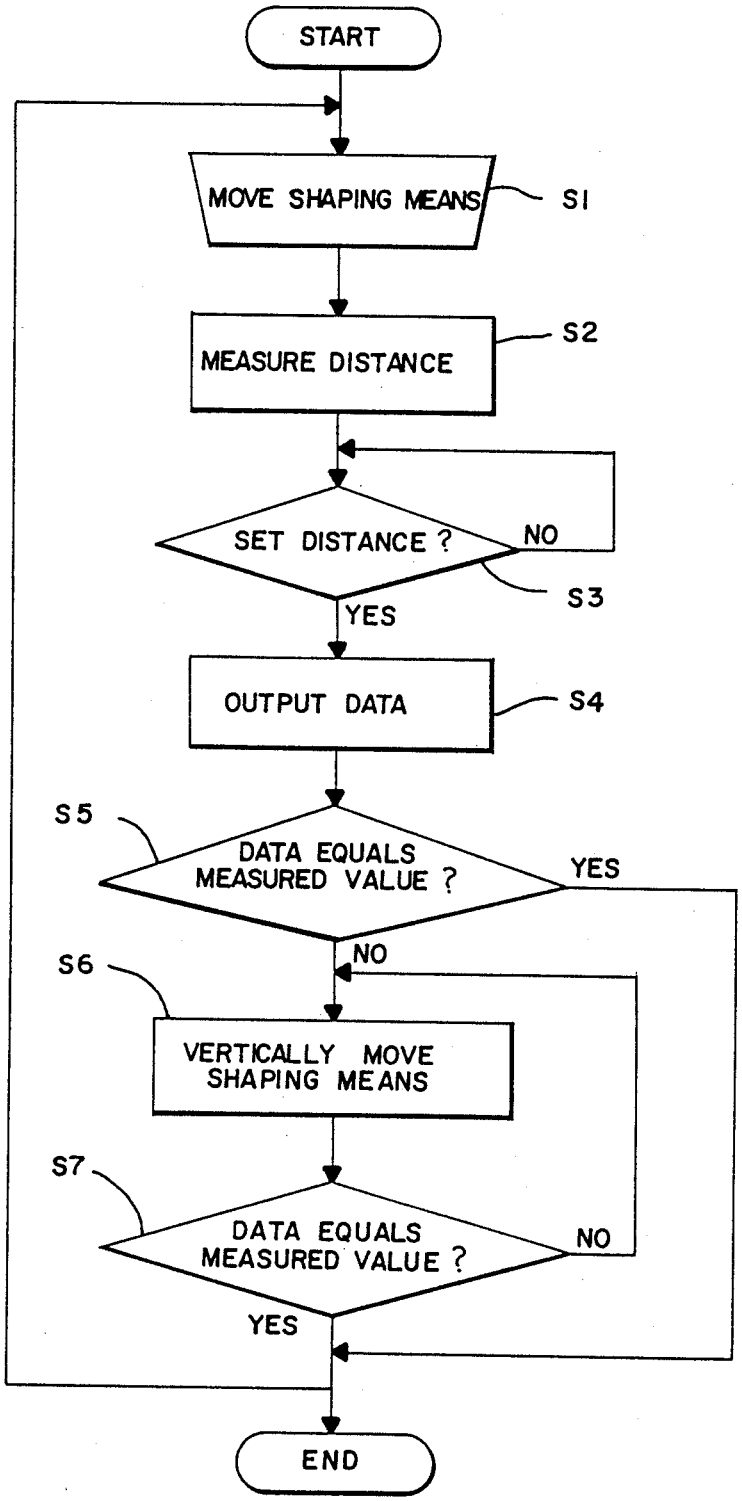

The shaping means S is moved lengthwise of the frame 201 by the motor 207 as shown at step Sl in FIG. 15. The moving distance is measured by the distance sensor 220 (step S2). A check is made in step S3 to see if the is equal to the set distance 13 or not. If YES, the values of hl to hn applicable to the positions ll to ln of the bracket 203 are output from the memory means 230 to the control means 231 (step S4). On the basis of this output, the screw jack 204 is driven to move the shaping means S to the proper height which is shown in FIG. 12. The moving amount of the shaping means S is measured by the rotation sensor 219 and fed back to the control means 231. A check is made to see if the output value of hl to hn is equal to the measured moving amount or not (step S5). If NO, the shaping means S is vertically moved by the screw jack 204 until they coincide (steps S6 and S7).

The shaping means S is set to the proper height as described above and the screw cutter 206 is rotated by the motor 217, thereby shaping the slope face C. The residual mud D and sands are discharged to the side by the screw cutter 206. The slope face C is shaped in this manner and the bracket 203 or shaping means S is moved to the next point 14 by the driving motor 207. When the distance sensor 220 measures the distance 14, the shaping means is similarly set to the position of the proper height. In this manner, the slope face C is similarly shaped until the distance ln at the height hn and the shaping work of the portion A2 is completed. Next, the tractor T is moved and the next roadbed sections or portions are similarly shaped in sequence.

We claim:

1. An apparatus for checking and measuring a surface which extends in a longitudinal direction and has a curved profile, comprising:
   - an elongated main frame which is disposable across said surface,
   - a plurality of extensible actuators mounted on said main frame, said actuators being spaced from and extensible toward the surface,
   - a flexible rule which is connected to said extensible actuators, said flexible rule being elongated in the same direction as the main frame,
   - control means for setting the extended positions of the extensible actuators to control the shape of the flexible rule,
   - memory means for storing data which defines a curved profile, and
   - means for operating said extensible actuators according to said data to shape said rule into said curved profile.

2. An apparatus according to claim 1 having transport means for transporting the main frame, extensible actuators and flexible rule to different sections of said surface to be checked and measured.

* * * * *